US009270017B2

(12) United States Patent
Villarroel et al.

(10) Patent No.: US 9,270,017 B2
(45) Date of Patent: Feb. 23, 2016

(54) MULTI-ELEMENT CAVITY-COUPLED ANTENNA

(75) Inventors: Wladimiro Villarroel, Ypsilanti, MI (US); Jesus Gedde, Dexter, MI (US)

(73) Assignee: AGC AUTOMOTIVE AMERICAS R&D, INC., Ypsilanti, MI (US)

( * ) Notice: Subject to any disclaimer, the term of this patent is extended or adjusted under 35 U.S.C. 154(b) by 964 days.

(21) Appl. No.: 12/865,939

(22) PCT Filed: Dec. 29, 2008

(86) PCT No.: PCT/US2008/014088

§ 371 (c)(1),
(2), (4) Date: Oct. 26, 2010

(87) PCT Pub. No.: WO2009/099427

PCT Pub. Date: Aug. 13, 2009

(65) Prior Publication Data

US 2011/0032164 A1 Feb. 10, 2011

Related U.S. Application Data

(60) Provisional application No. 61/063,562, filed on Feb. 4, 2008.

(51) Int. Cl.
*H01Q 1/32* (2006.01)
*H01Q 1/12* (2006.01)
(Continued)

(52) U.S. Cl.
CPC ..... *H01Q 1/3275* (2013.01); *H01Q 1/1271* (2013.01); *H01Q 9/0428* (2013.01); *H01Q 9/0457* (2013.01); *H01Q 9/065* (2013.01); *H01Q 9/285* (2013.01); *H01Q 21/26* (2013.01)

(58) Field of Classification Search
CPC ... H01Q 1/1271; H01Q 21/26; H01Q 1/3275; H01Q 9/065; H01Q 9/285; H01Q 9/0457
USPC ..... 343/713, 700 MS, 725, 727, 730, 789
See application file for complete search history.

(56) References Cited

U.S. PATENT DOCUMENTS 3,813,674 A 5/1974 Sidford
4,054,874 A * 10/1977 Oltman, Jr. ..... 343/700 MS
(Continued)

FOREIGN PATENT DOCUMENTS

EP 1667276 A1 6/2006
EP 1744399 A1 1/2007
(Continued)

OTHER PUBLICATIONS

English language translation and abstract for JP 2006-229871 extracted from PAJ database Feb. 14, 2011, 33 pages.
(Continued)

*Primary Examiner* — Dameon E Levi
*Assistant Examiner* — Hasan Islam
(74) *Attorney, Agent, or Firm* — Howard & Howard Attorneys PLLC

(57) ABSTRACT

An antenna (10) suitable for receiving circularly polarized RF signals from a satellite is integrated with a window (12) of a vehicle (14), such as a roof window (12). The antenna (10) includes a patch element (18) disposed adjacent to the window (12). Radiating strips (26) forming at least one dipole pair are disposed below the patch element (18) and connectable to a transmission line. A coupling element (20) surrounds the radiating strips (26) and a dielectric layer (38) is sandwiched between the patch element (18) and the radiating strips (26). A ground plane (36) is also disposed below the radiating strip (26). A conductive casing (46) perpendicularly surrounds the antenna (10) elements while electrically connecting the ground plane (36) to the coupling element (20) such that the radiating strips (26) are generally disposed within a cavity (24).

21 Claims, 8 Drawing Sheets

(51) Int. Cl.

| | |
|---|---|
| ***H01Q 9/04*** | (2006.01) |
| ***H01Q 9/06*** | (2006.01) |
| ***H01Q 9/28*** | (2006.01) |
| ***H01Q 21/26*** | (2006.01) |

(56) References Cited

U.S. PATENT DOCUMENTS

| | | | | | |
|---|---|---|---|---|---|
| 4,443,802 | A | * | 4/1984 | Mayes | 343/729 |
| 4,486,758 | A | * | 12/1984 | de Ronde | 343/700 MS |
| 4,675,685 | A | * | 6/1987 | Finken | 343/708 |
| 4,853,703 | A | * | 8/1989 | Murakami et al. | 343/700 MS |
| 5,142,698 | A | | 8/1992 | Koga et al. | |
| 5,208,602 | A | | 5/1993 | Monser et al. | |
| 5,233,364 | A | * | 8/1993 | Lefeuvre et al. | 343/789 |
| 5,280,286 | A | | 1/1994 | Williamson | |
| 5,293,176 | A | * | 3/1994 | Elliot | 343/797 |
| 5,300,936 | A | * | 4/1994 | Izadian | 343/700 MS |
| 5,453,754 | A | | 9/1995 | Fray | |
| 5,465,100 | A | * | 11/1995 | Remondiere | H01Q 9/0464 343/769 |
| 5,703,601 | A | | 12/1997 | Nalbandian et al. | |
| 5,801,660 | A | * | 9/1998 | Ohtsuka et al. | 343/700 MS |
| 6,023,244 | A | | 2/2000 | Snygg et al. | |
| 6,087,989 | A | | 7/2000 | Song et al. | |
| 6,680,712 | B2 | | 1/2004 | Yamamoto et al. | |
| 6,731,243 | B2 | | 5/2004 | Taira et al. | |
| 6,940,457 | B2 | | 9/2005 | Lee et al. | |
| 7,612,727 | B2 | * | 11/2009 | Schwenke | 343/713 |
| 7,619,568 | B2 | * | 11/2009 | Gillette | 343/700 MS |
| 2006/0097923 | A1 | | 5/2006 | Li et al. | |
| 2007/0080864 | A1 | | 4/2007 | Channabasappa | |
| 2007/0126638 | A1 | | 6/2007 | Channabasappa | |
| 2007/0268188 | A1 | | 11/2007 | Guha et al. | |
| 2008/0129635 | A1 | | 6/2008 | Surittikul et al. | |

FOREIGN PATENT DOCUMENTS

| | | | |
|---|---|---|---|
| EP | 1775795 | A1 | 4/2007 |
| GB | 2408149 | A | 5/2005 |
| JP | 2006-229871 | A | 8/2006 |
| JP | 2007-235592 | A | 9/2007 |
| WO | WO 2007-106975 | A1 | 9/2007 |

OTHER PUBLICATIONS

English language translation and abstract for JP 2007-235592 extracted from PAJ database Feb. 14, 2011, 32 pages.

PCT International Search Report PCT/US2008/014088, dated Mar. 27, 2009, 3 pages.

* cited by examiner

MULTI-ELEMENT CAVITY-COUPLED ANTENNA

CROSS REFERENCE TO RELATED APPLICATION

This application claims priority to and the benefit of PCT International Patent Application No. PCT/US2008/014088, filed on Dec. 29, 2008, and U.S. Provisional Application No. 61/063,562, filed Feb. 4, 2008, which is hereby incorporated by reference.

BACKGROUND OF THE INVENTION

1. Field of the Invention

The subject invention relates to antennas. Particularly, the subject invention relates to microstrip antennas for circular polarization applications.

2. Description of the Related Art

Antennas for receiving signals from a satellite, such as Satellite Digital Audio Radio Service (SDARS) signals, are well known in the art. These antennas are routinely carried on vehicles for use with the vehicle's radio receiver. Typically, these antennas are mounted on a metallic roof of the vehicle such that the roof acts as a ground plane for the antenna. Furthermore, these antennas often have a bulky appearance that is not aesthetically pleasing from the outside of the vehicle.

Many modern vehicles incorporate glass into their roof. The amount of glass used can range from a typical sunroof that provides glass over a small portion of the vehicle roof to a panoramic-style glass that spans the entire roof area of the vehicle. Unfortunately, the use of glass in vehicle roof structures reduces the amount of sheet metal that can be used as a ground plane for a satellite antenna. As such, typical satellite antennas suffer from lower performance when disposed on glass.

Therefore, there remains an opportunity for an antenna that may be integrated with glass, such as a glass roof of a vehicle, for receiving signals from a satellite.

SUMMARY OF THE INVENTION AND ADVANTAGES

The subject invention provides an antenna including a patch element formed of conductive material. The antenna also includes a coupling element formed of conductive material and having an interior edge defining a cavity. The coupling element is disposed non-planar with and generally parallel to the patch element. A plurality of radiating strips are formed of conductive material and arranged as at least one dipole pair. The radiating strips are disposed non-planar with and generally parallel to the patch element. The radiating strips are also disposed within the interior edge of the coupling element. The antenna also includes a first dielectric layer formed of a non-conductive material and sandwiched between the patch element and both the radiating strips and the coupling element. The antenna may also be integrated with a window having a non-conductive pane of transparent material.

The window having the integrated antenna may be a glass roof of a vehicle. The unique structure of the antenna makes it ideal to receive signals from satellites through the glass with performance that is comparable to sheet metal mounted antennas that are prevalent in the prior art. Specifically, the antenna of the subject invention provides radiation pattern coverage at lower elevation angles, i.e., angle coverage as low as 20 degrees, which is the lowest satellite elevation required by SDARS providers.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, an antenna is shown at 10.

Figure 1A:
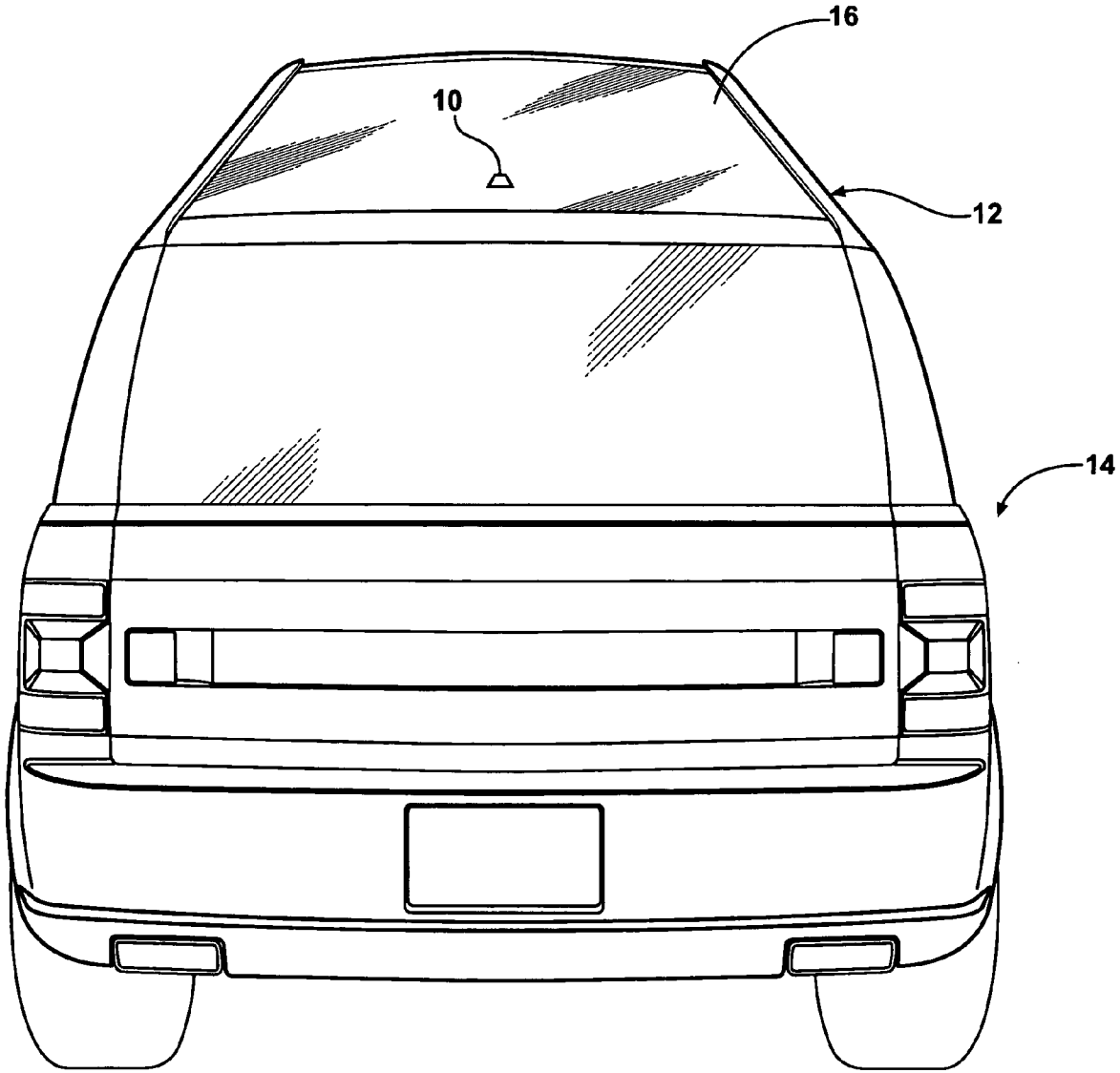
FIG. 1A is a perspective view of a first vehicle with an antenna supported by a glass roof of the vehicle.
Figure 1B:
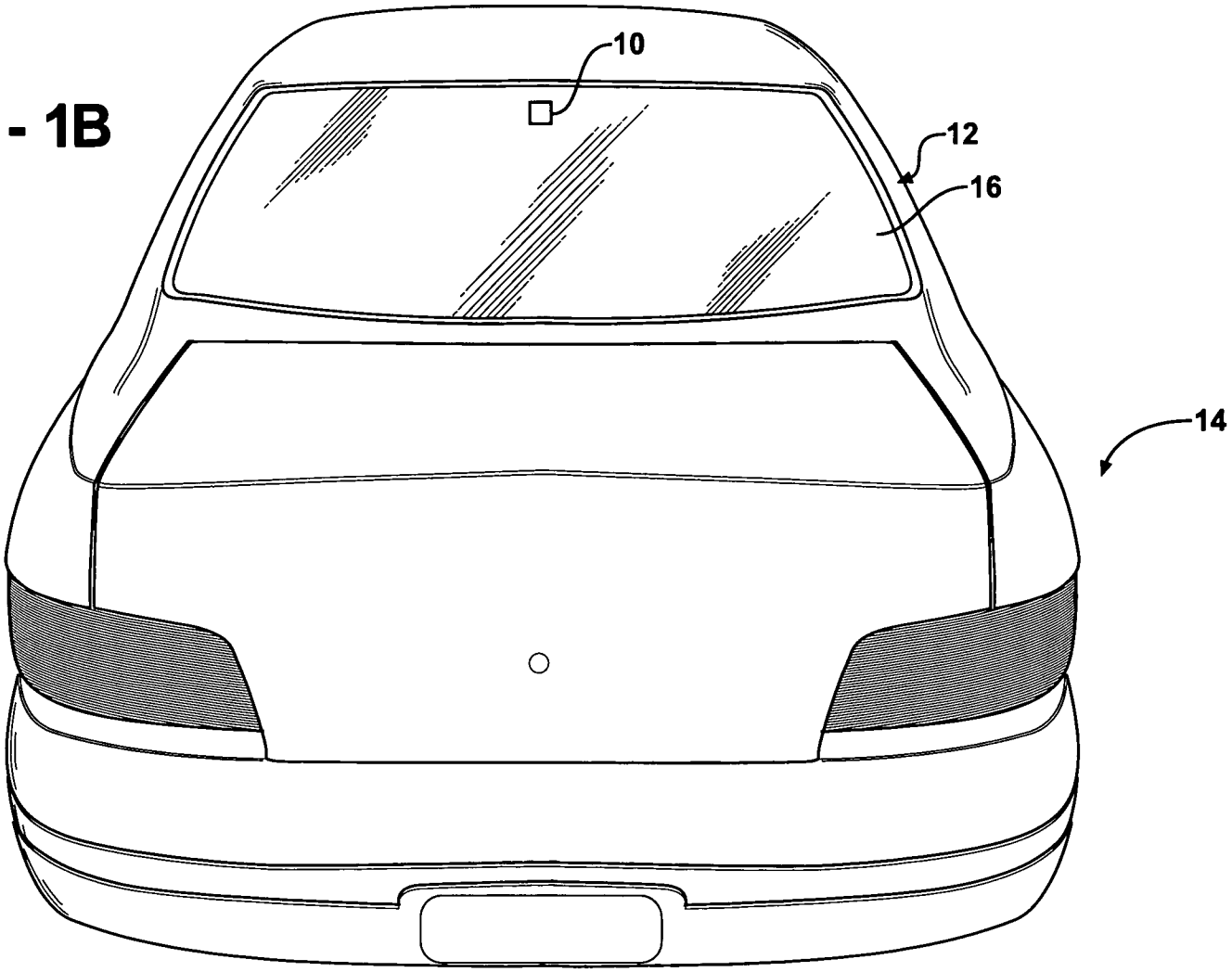
FIG. 1B is a perspective view of a second vehicle with an antenna supported by a rear window of the vehicle.

Referring to FIGS. 1A and 1B, the antenna 10 is preferably integrated with a window 12 of a vehicle 14. The window 12 is preferably formed of at least one non-conductive pane 16 of transparent material, such as glass. However, other materials may also be suitable for forming the transparent, non-conductive pane 16, including, but not limited to, a plastic and/or a resin. Those skilled in the art realize that transparent materials allow light rays to be transmitted through in at least one direction such that objects on the other side of the transparent material may be seen.

The window 12 may be a rear window (backlite), a front window (windshield), sunroof, roof window, or any other window or tilter/non-tilter pane of the vehicle 14. The window 12 may alternatively be utilized in non-vehicle applications such as buildings (not shown). The antenna 10 may also be implemented in non-window applications, including, but not limited to, electronic devices such as cellular phones. Of course, those skilled in the art realize other applications for the antenna 10.

The antenna 10 of the illustrated embodiments may be utilized for transmitting and/or receiving radio frequency (RF) signals. Preferably, the RF signal has a circular polarization, such as those utilized by Satellite Digital Audio Radio Service (SDARS) providers, such as XM Radio or Sirius Satellite Radio. More preferably, the antenna 10 of the illustrated embodiments operates on RF signals having a frequency around 2,338 MHz, which corresponds to a commonly utilized SDARS frequency band. The antenna 10 may also be utilized with other signal polarizations and/or at other frequencies, as is readily recognized by those skilled in the art. However, for explanatory purposes, the dimensions of the antenna 10 described hereafter relate to the 2,338 MHz SDARS frequency band. Those skilled in the art appreciate that these dimensions may be modified based on a desired operation of the antenna 10 and should not be read as limiting in any way.

Figure 2:
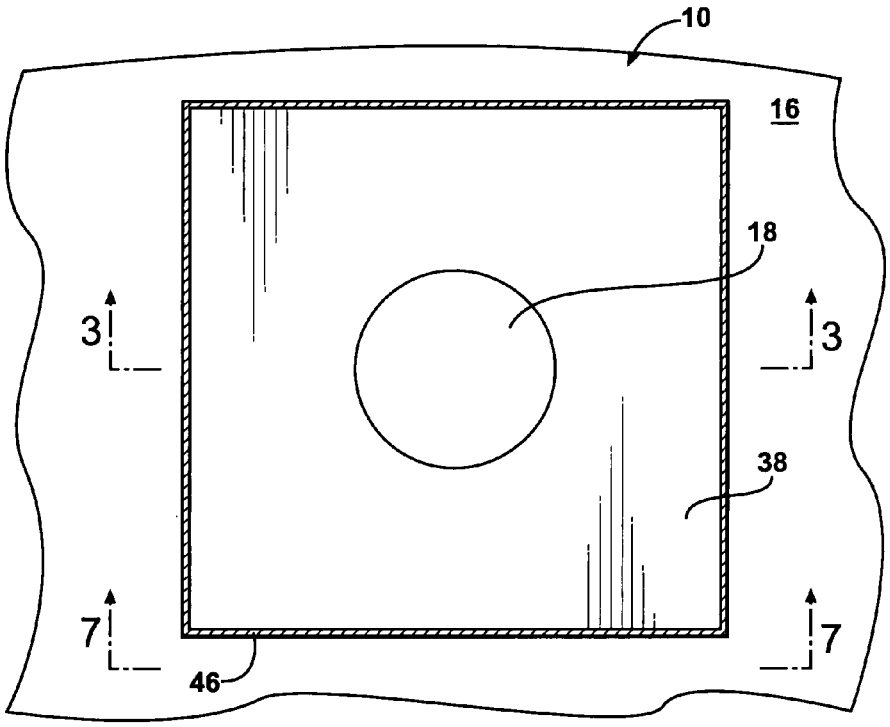
FIG. 2 is a top view of a first embodiment of the antenna showing a patch element and a first dielectric layer as seen through the pane of glass.
Figure 3:
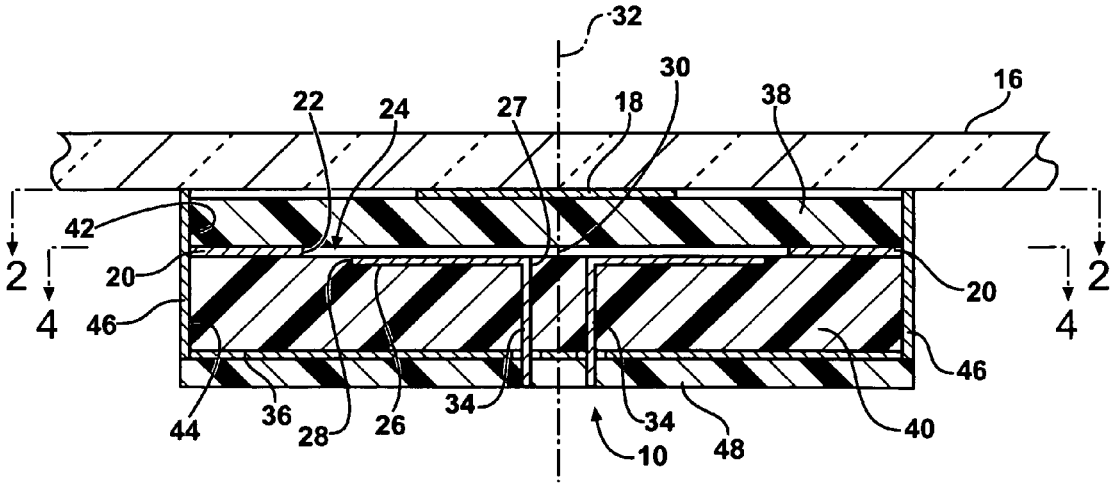
FIG. 3 is a cross-sectional side view of the first embodiment of the antenna taken along line 3-3 in FIG. 2 showing radiating strips disposed below a coupling element.

Referring to FIG. 2, the antenna 10 includes a patch element 18 formed of conductive material. The conductive material may be a metal, such as copper, gold, silver, etc., or other material that conducts electricity. The patch element 18 is disposed adjacent the non-conductive pane 16. In the illustrated embodiments, as shown in FIG. 3, the patch element 18 is in contact with the non-conductive pane 16. Preferably, the patch element 18 is a silver paste that is printed on the non-conductive pane 16 and then hardened with a firing process as is known to those skilled in the art.

Preferably, the patch element 18, as well as the other components of the antenna 10 defined below, are disposed inside of the vehicle 14. As such, the antenna 10 is not easily visible from outside of the vehicle 14, which allows the vehicle 14 to maintain a streamlined and aesthetically pleasing appearance.

In the illustrated embodiments, the patch element 18 defines a generally circular shape. The circular shape assists in providing a uniform radiating effect along an edge of the radiating patch element 18. However, other shapes of the patch element 18 may alternatively be utilized, including, but not limited to, rectangular or triangular shapes. To correspond to the SDARS frequency band described above, the patch element 18 has a diameter of about 20 mm.

The antenna 10 also includes a coupling element 20 formed of conductive material. The conductive material may be a metal or other material that conducts electricity. The coupling element has an interior edge 22 defining a cavity 24. Preferably, the interior edge 22 of the coupling element 20 defines a generally rectangular shape. More preferably, and as shown in the illustrated embodiments, the interior edge 22 of the coupling element 20 defines a square shape. Accordingly, the cavity 24 also defines a square shape. However, the interior edge 22 of the coupling element 20, and the cavity 24, may alternatively define other shapes including, but not limited to, circles, triangles, and other polygons.

The coupling element 20 is disposed non-planar with the patch element 18. More specifically, as shown in FIG. 3, the coupling element 20 is disposed below the patch element 18. Said another way, the coupling element 20 is disposed on the same side of the non-conductive pane 16 as the patch element 18, but spaced apart from the non-conductive pane 16 and the patch element 18. The coupling element 20 is also disposed generally parallel to the patch element 18.

The antenna 10 also includes a plurality of radiating strips 26 formed of conductive material. In one implementation, the radiating strips 26 may be produced with printed and hardened silver paste as is commonly known in the art. In another implementation, the radiating strips 26 may be segments of wire. However, those skilled in the art realize other techniques to implement the radiating strips 26.

As with the coupling element 20, the radiating strips 26 are disposed non-planar with and generally parallel to the patch element 18. As such, the radiating strips 26 are also generally parallel to the coupling element 20. Furthermore, in the illustrated embodiments, the radiating strips 26 are also disposed below the patch element 18.

Figure 4:
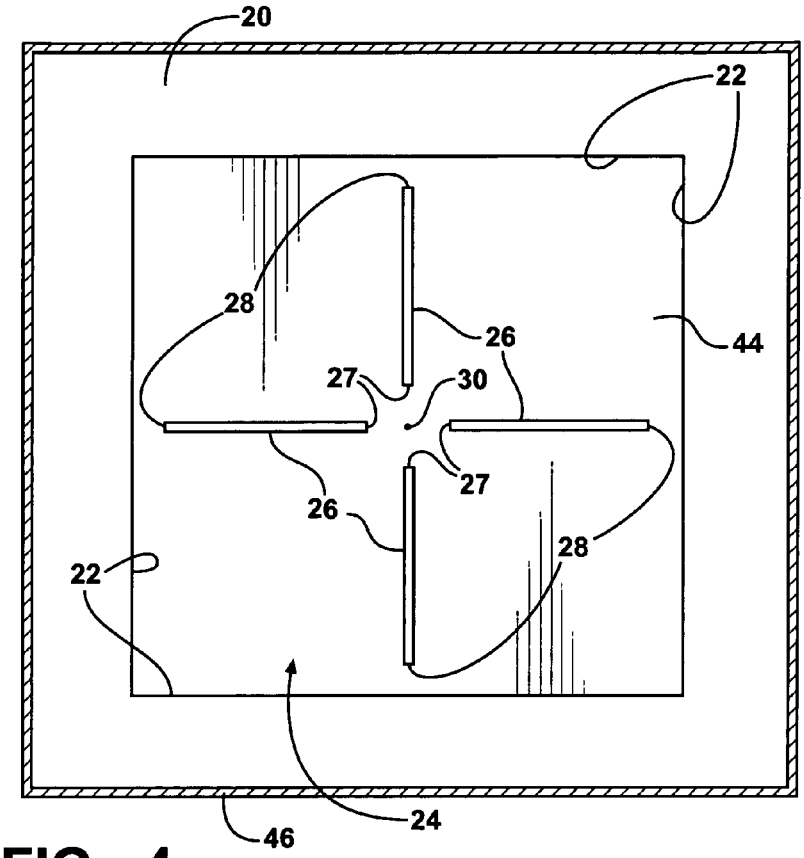
FIG. 4 is a cross-sectional top view of the first embodiment of the antenna taken along line 4-4 in FIG. 3 showing the radiating strips, the coupling element, and a second dielectric.
Figure 5:
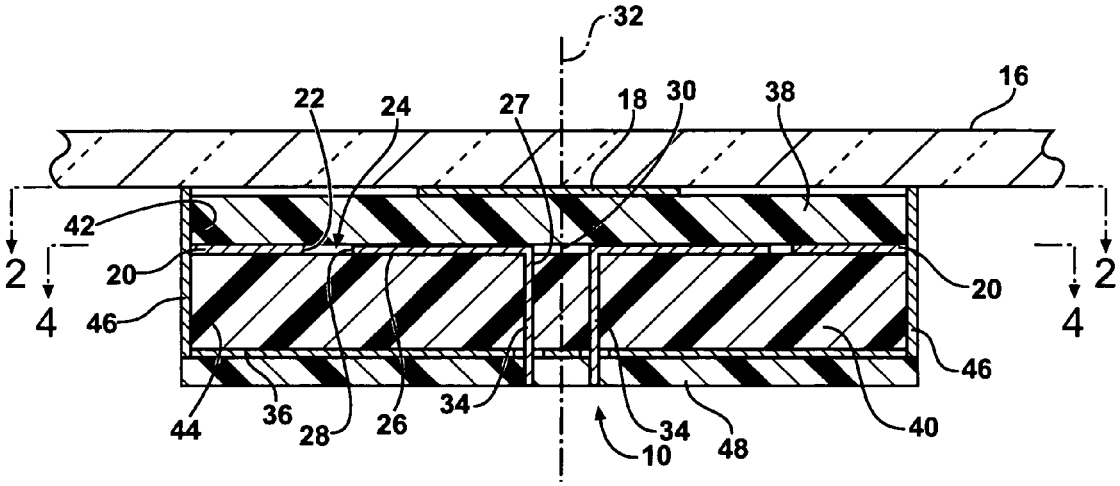
FIG. 5 is a cross-sectional side view of a second embodiment of the antenna showing the radiating strips disposed generally coplanar with the coupling element.
Figure 6:
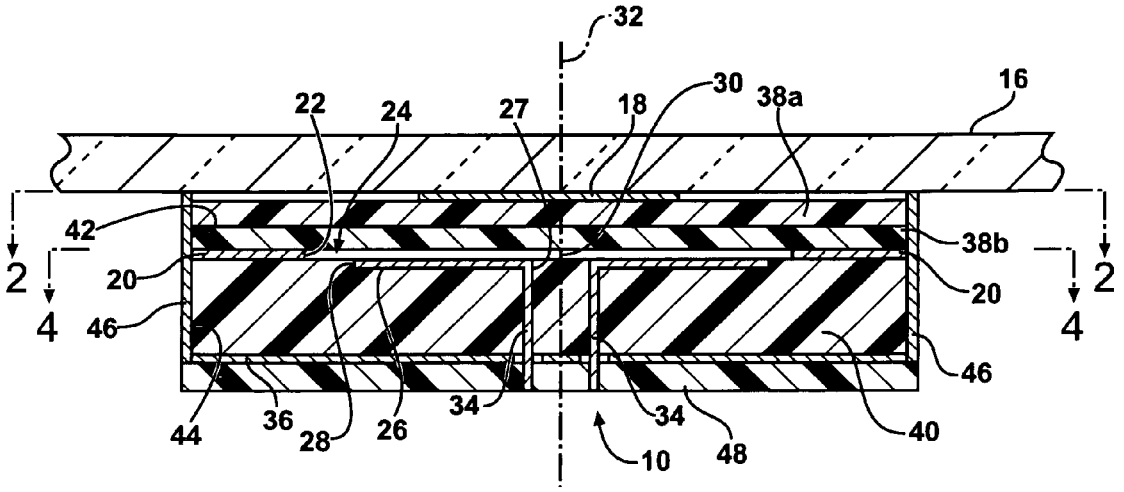
FIG. 6 is a cross-sectional side view of a second embodiment of the antenna showing the first dielectric layer divided into first and second sublayers.

The radiating strips 26 are arranged as at least one dipole pair (not numbered). In the illustrated embodiment, the plurality of radiating strips 26 is further defined as four radiating strips 26. Furthermore, the four radiating strips 26 are arranged as two dipole pairs in a crossed-dipole pattern, as can be seen in FIG. 4. That is, the four radiating strips 26 do not contact one another, yet form the shape of a cross. Specifically, in the illustrated embodiments, each radiating strip 26 includes a proximal end 27 and a distal end 28 where the proximal ends 27 are disposed adjacent a common point 30. Moreover, as shown in FIGS. 3, 5, and 6, an axis 32 extends through the common point 30 and the patch element 18, the coupling element 20, and the radiating strips 26 are generally symmetric about the axis 32. The common point 30 and the axis 32 are preferably located at a center point of the antenna 10; however, this condition is not fundamentally necessary.

This crossed-dipole arrangement of the radiating strips 24 assists in providing the antenna 10 in transmitting and/or receiving the RF signal with circular polarization. In the illustrated embodiments, the length of each radiating strip measures about 17 mm. The proximal ends 27 are separated from the common point by about 1 mm. As such, proximal ends 27 of each dipole pair are separated from one another by about 2 mm.

The radiating strips 26 are disposed within the interior edge 22 of the coupling element 20. Said another way, the radiating strips 26 do not contact or overlap the coupling element 20. As such, the radiating strips 26 appear to be disposed within the cavity 24. In the illustrated embodiments, each radiating strip 26 is separated from the interior edge 22 of the coupling element 20 by about 1 mm.

As can be best seen in FIG. 3, the radiating strips 26 of a first embodiment are disposed below the coupling element 20, such that the radiating strips 26 are non-planar with the coupling element 20. However, in a second embodiment, shown in FIG. 5, the radiating strips 26 may be generally co-planar with the coupling element 20. In other embodiments (not shown), the radiating strips 26 may be disposed above the coupling element 20.

The antenna 10 may also include a plurality of feed elements 34 formed of conductive material, as shown in FIGS. 3, 5, and 6. Each feed element 34 is electrically connected to one of the radiating strips 26. Specifically, in the illustrated embodiment, each feed element 34 is electrically connected to the proximal end 27 of each radiating strip 26. The feed elements 34 of the illustrated embodiments are generally perpendicular to the radiating strips 26 and extend downward, i.e., away from the coupling element 20.

The antenna 10 preferably includes a ground plane 36 formed of a conductive material for reflecting energy received and/or transmitted by the antenna 10. The ground plane 36 is disposed generally parallel with the patch element 18, the coupling element 20, and the radiating strips 26. The ground plane 36 is also disposed below, i.e., non-planar with, the patch element 18, the coupling element 20, and the radiating strips 26. The ground plane 36 is preferably substantially flat and defines a rectangular shape. More preferably, the ground plane 36 defines a square shape. However, other shapes may also be acceptable. In the illustrated embodiment, the ground plane 36 has a length of about 60 mm and a width of about 60 mm. The ground plane 36 of the illustrated embodiments also defines transit holes (not numbered) to allow the radiating strips 26 to pass through the ground plane 36 without making electrical contact with the ground plane 36.

A first dielectric layer 38 is sandwiched between the patch element 18 and both the radiating strips 26 and the coupling element 20. A second dielectric layer 40 is sandwiched between both the coupling element 20 and the radiating strips 26 and the ground plane 36. The dielectric layers 38, 40 are formed of non-conductive material to provide an insulating layer. In the first and second embodiments, the first dielectric layer 38 has a height of about 5 mm while the second dielectric layer 38 has a height of about 10 mm. The dielectric layers 38, 40 each have a relative permittivity between 1 and 100. Preferably, the relative permittivity of each dielectric layer 38, 40 are different For example, the first dielectric layer 38 may be a plastic and the second dielectric layer 40 may be an air gap. However, it is to be appreciated that the first and second dielectric layers 38, 40 may be formed from other materials. The difference between the relative permittivity of the first and second dielectric layers 38, 40 may be dependent upon the SDARS application and the characteristics of the signal received by the antenna 10.

Both dielectric layers 38, 40 are preferably shaped and sized to align with the coupling element 20 and the ground plane 36. As such, in the illustrated embodiment, the dielectric layers 38, 40 each have substantially square shape with a length of about 60 mm and a width of about 60 mm. The dielectric layers 38, 40 each define respective peripheral sides 42, 44, as can be see in FIGS. 3, 5, and 6.

In a third embodiment, as shown in FIG. 6, the first dielectric layer 38 is divided into a first sublayer 38*a* and a second sublayer 38*b*. The first sublayer 38*a* is disposed adjacent the patch element 18 and has a height of about 2.5 mm. The second sublayer 38*b* is disposed adjacent both the coupling element 20 and the radiating strips 26 and has a height of about 2.5 mm. The sublayers 38*a*, 38*b* each have a relative permittivity between 1 and 100. The sublayers 38*a*, 38*b* help to improve matching (loading) of the antenna 10 and help to shape the radiation pattern to improve performance of the antenna 10.

Figure 7:
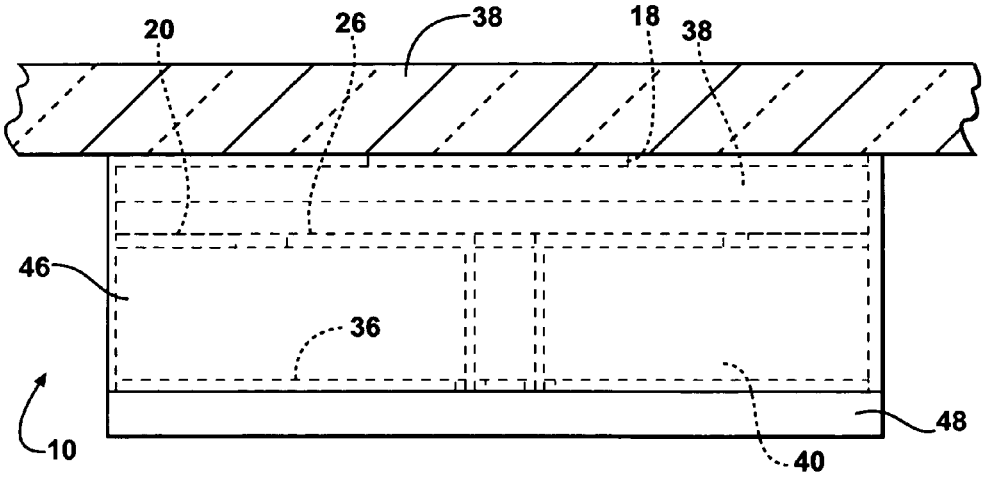
FIG. 7 is a side view of the antenna showing a conductive casing which encompasses the patch element, radiating strips, and dielectric layers.

The antenna 10 preferably includes a conductive casing 46 formed of a conductive material. The conductive casing 46 is disposed adjacent the peripheral sides 42, 44 of the dielectric layers 38, 40. More specifically, the conductive casing 46 is disposed on the peripheral sides 42, 44. As such, the conductive casing 46 wraps around the entire periphery of the antenna 10, as is shown in FIG. 7. It is preferred that the conductive casing 46 is electrically connected to the coupling element 20, as is shown in the illustrated embodiments. It is also preferred that the conductive casing 46 is electrically connected to the ground plane 36, as is also shown in the illustrated embodiments. The conductive casing 46, in concert with the ground plane 36 and the coupling element 20, assists in preventing loss of radiation from the bottom and the sides of the antenna 10 and to concentrate all radiation toward the patch element 18 at the top of the antenna 10.

Figure 8:
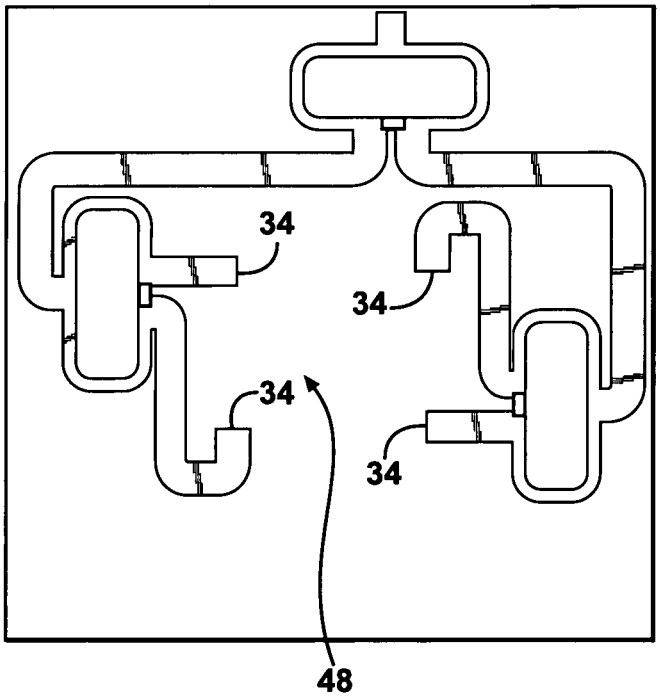
FIG. 8 is a bottom view of a feeding network of the antenna.

Referring to FIG. 8, the antenna 10 also includes a feeding network 48 for facilitating a connection and impedance matching between the antenna 10 and RF circuitry (not shown). The feeding network 48 also provides the proper phase difference between the pair of dipoles formed by the radiating strips 26, allowing the antenna 10 to operate with circular polarization characteristics. An example of the feeding network 48 is disclosed in U.S. patent application Ser. No. 11/739,885, filed Apr. 25, 2007, which is hereby incorporated by reference. In the illustrated embodiment, the feed elements 34 are electrically connected to the feeding network 48. A transmission line (not shown) may be utilized to electrically connect the feeding network 48 to the RF circuitry, such as a receiver and/or a transmitter.

Additionally, an amplifier (not shown) may be disposed on or integrated with the feeding network 48. The amplifier is preferably a low-noise amplifier (LNA) such as those well known to those skilled in the art.

Figure 9:
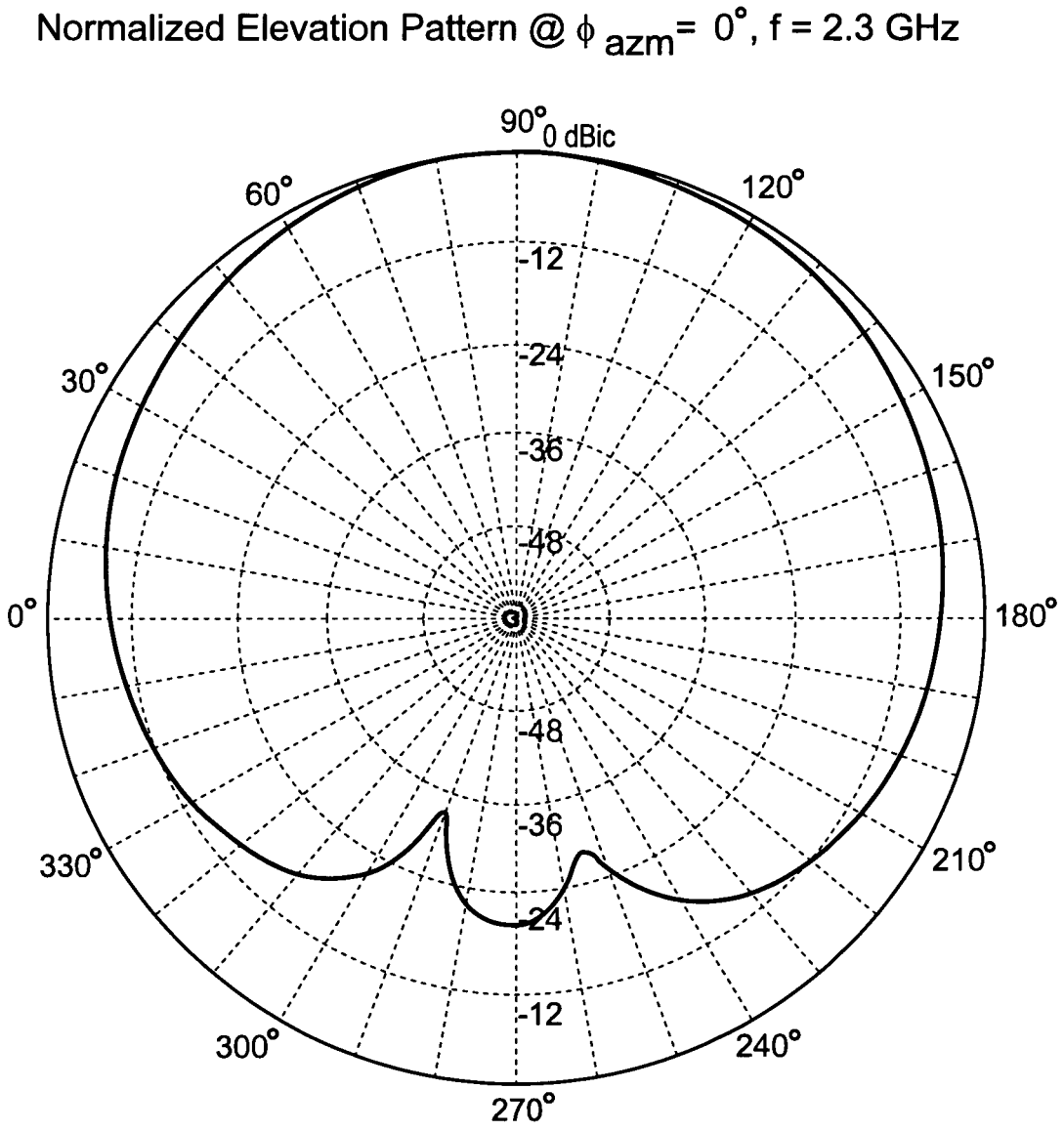
FIG. 9 is a chart showing an elevation radiation pattern of the antenna at an azimuthal angle of about zero degrees.
Figure 10:
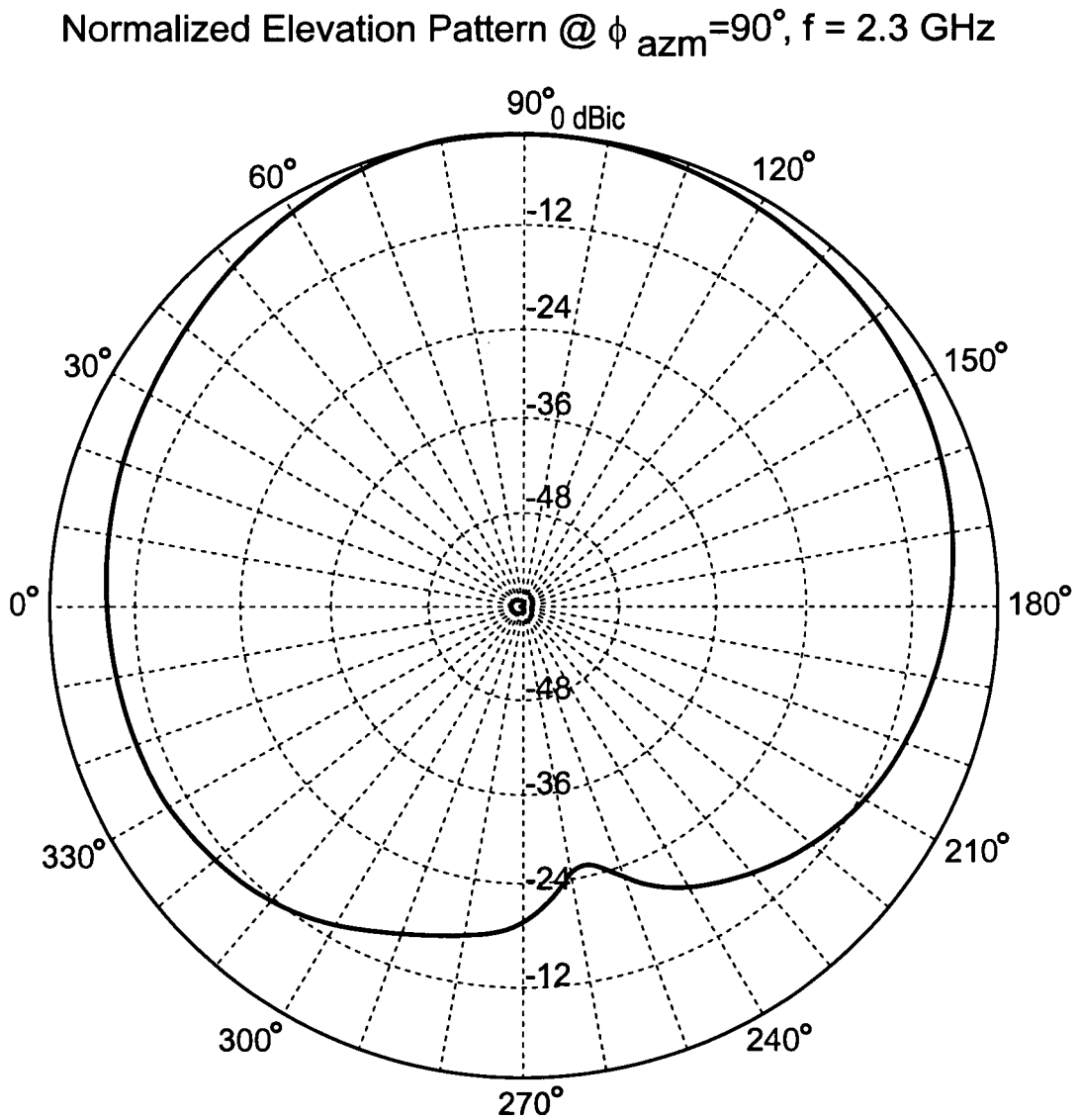
FIG. 10 is a chart showing the elevation radiation pattern of the antenna at an azimuthal angle of about 90 degrees.

The unique structure of the antenna 10 makes it ideal to receive signals from satellites through the window 12. As a measure of success for the claimed invention, development focused on gain characteristics that are equivalent to sheet metal mounted antennas that are prevalent in the prior art. Accordingly, the performance of the subject antenna 10 is comparable to such sheet metal mounted antennas. Specifically, the antenna 10 of the subject invention provides radiation pattern coverage at lower elevation angles, as shown in FIGS. 9 and 10. The angle coverage of the radiation pattern is as low as 20 degrees, which is the lowest satellite elevation required by SDARS providers.

The present invention has been described herein in an illustrative manner, and it is to be understood that the terminology that has been used is intended to be in the nature of words of description rather than of limitation. Obviously, many modifications and variations of the invention are possible in light of the above teachings. The invention may be practiced otherwise than as specifically described within the scope of the appended claims. In addition, the reference numerals in the claims are merely for convenience and are not to be read in any way as limiting.

What is claimed is:

1. An antenna (10) comprising:

a patch element (18) formed of conductive material;

a coupling element (20) formed of conductive material and having an interior edge (22) defining a cavity (24), said coupling element (20) disposed non-planar with and generally parallel to said patch element (18);

a plurality of radiating strips (26) formed of conductive material and arranged as at least two dipole pairs in a crossed-dipole pattern and disposed non-planar with and generally parallel to said patch element (18);

said interior edge (22) of said coupling element (20) is disposed around said radiating strips (26) such that an entirety of said radiating strips (26) is disposed within said interior edge (22);

a plurality of feed elements (34) being in direct electrical connection with said radiating strips (26), and having no direct electrical connection with said patch element (18) such that said patch element (18) operates passively;

a first dielectric layer (38) formed of a non-conductive material and defining a first surface disposed adjacent said patch element (18) and an opposing second surface disposed adjacent to both said coupling element (20) and said radiating strips (26) such that said first dielectric layer (38) is sandwiched between said patch element (18) and both of said coupling element (20) and said radiating strips (26), said first dielectric layer (38) defining a peripheral side (42) connecting said first and second surfaces; and a conductive casing (46) formed of a conductive material and disposed on said peripheral side (42) of said first dielectric layer (38).

2. An antenna (10) as set forth in claim 1 wherein said plurality of radiating strips (26) is further defined as four radiating strips (26).

3. An antenna (10) as set forth in claim 1 further comprising a ground plane (36) formed of a conductive material and disposed non-planar to and generally parallel with said radiating strips (26) and opposite said patch element (18).

4. An antenna (10) as set forth in claim 3 further comprising a second dielectric layer (40) formed of a non-conductive material and sandwiched between said radiating strips (26) and said ground plane (36).

5. An antenna (10) as set forth in claim 4 wherein said second dielectric layer (40) defines a third surface disposed adjacent said radiating strips (26) and an opposing fourth surface disposed adjacent said ground plane (36) and a peripheral side (44) connecting said third and fourth surfaces and with a conductive casing (46) being disposed on said peripheral side (44) of said second dielectric layer (40).

6. An antenna (10) as set forth in claim 5 wherein said conductive casing (46) is electrically connected to said coupling element (20).

7. An antenna (10) as set forth in claim 5 wherein said conductive casing (46) is electrically connected to said ground plane (46) and said coupling element (20).

8. An antenna (10) as set forth in claim 1 wherein each radiating strip (26) includes a proximal end (27) and a distal end (28) with said proximal ends (27) disposed adjacent a common point (30).

9. An antenna (10) as set forth in claim 8 wherein an axis (32) extends through said common point (30) and wherein said patch element (18), said coupling element (20), and said radiating strips (26) are generally symmetric about said axis (32).

10. An antenna (10) as set forth in claim 1 wherein said radiating strips (26) are generally co-planar with said coupling element (20).

11. An antenna (10) as set forth in claim 1 wherein said patch element (18) defines a generally circular shape.

12. An antenna (10) as set forth in claim 1 wherein said interior edge (22) of said coupling element (20) defines a rectangular shape.

13. An antenna (10) as set forth in claim 1 wherein the interior edge (22) of the coupling element (20) is continuous around the radiating strip (26).

14. An antenna (10) as set forth in claim 1 wherein lengths of each radiating strip (26) are equal to one another.

15. An antenna (10) as set forth in claim 1 wherein said conductive casing (46) surrounds said peripheral edge (42) of said first dielectric layer (38).

16. An antenna (10) as set forth in claim 5 wherein said conductive casing (46) surrounds said peripheral edge (44) of said second dielectric layer (40).

17. A window (12) having an integrated antenna (10), said window (12) comprising:

a nonconductive pane (16) of transparent material;

a patch element (18) formed of conductive material and abutting said non-conductive pane (16);

a coupling element (20) formed of conductive material and having an interior edge (22) defining a cavity (24), said coupling element (20) disposed non-planar with and generally parallel to said patch element (18);

a plurality of radiating strips (26) formed of conductive material and arranged as at least two dipole pairs in a crossed-dipole pattern and disposed non-planar with and generally parallel to said patch element (18);

said interior edge (22) of said coupling element (20) is disposed around said radiating strips (26) such that an entirety of said radiating strips (26) is disposed within said interior edge (22);

a plurality of feed elements (34) being in direct electrical connection with said radiating strips (26), and having no direct electrical connection with said patch element (18) such that said patch element (18) operates passively;

a first dielectric layer (38) formed of a non-conductive material and defining a first surface disposed adjacent said patch element (18) and an opposing second surface disposed adjacent to both said coupling element (20) and said radiating strips (26) such that said first dielectric layer (38) is sandwiched between said patch element (18) and both said coupling element (20) and said radiating strips (26), said first dielectric layer (38) defining a peripheral side (42) connecting said first and second surfaces;

a ground plane (36) formed of a conductive material and disposed non-planar to and generally parallel with said radiating strips (26) and opposite said patch element (18); and a conductive casing (46) formed of a conductive material and disposed on said peripheral side (42) of said first dielectric layer (38).

18. A window (12) as set forth in claim 17 wherein said nonconductive pane (16) is formed of glass.

19. A window (12) as set forth in claim 17 wherein said plurality of radiating strips (26) is further defined as four radiating strips (26).

20. A window (12) as set forth in claim 17 which is at least part of a roof of a vehicle (14) and disposed substantially parallel to the ground.

21. A window (12) as set forth in claim 17 wherein said conductive casing (46) is electrically connected to said ground plane (36) and surrounds said coupling element (20), said radiating strips (26), said peripheral edge (44) of said first dielectric layer (38), and said ground plane (36).

* * * * *